US005579990A

United States Patent [19]

Durand

[11] Patent Number: 5,579,990

[45] Date of Patent: Dec. 3, 1996

[54] CARTON FOR GLASS

[75] Inventor: Jean-Jacques Durand, Arques, France

[73] Assignee: Verrerie Cristallerie d'Arques, J. G. Durand et Cie, Arques, France

[21] Appl. No.: 540,888

[22] Filed: Oct. 11, 1995

[51] Int. Cl.[6] ..... B65D 5/48

[52] U.S. Cl. ..... 229/120.17; 229/120.05; 229/162

[58] Field of Search ..... 229/120.05, 120.17, 229/162; 206/45.31

[56] References Cited

U.S. PATENT DOCUMENTS

| | | | |
|---|---|---|---|
| 1,831,920 | 11/1931 | Marsh | 229/162 |
| 2,013,227 | 9/1935 | Wilson | 206/45.31 |
| 2,586,886 | 2/1952 | Tyrseck | 229/120.17 |
| 2,785,846 | 3/1957 | Weiner | 229/162 |
| 2,801,783 | 8/1957 | Fink | 229/162 |
| 2,909,311 | 10/1959 | Levitt | 229/120.17 |
| 3,145,902 | 8/1964 | Nolen | 229/120.17 |
| 3,245,526 | 4/1966 | Palmer | 229/162 |
| 3,283,950 | 11/1966 | Bolding | 229/120.17 |
| 3,322,265 | 5/1967 | Collusa | 206/45.31 |
| 4,192,444 | 3/1980 | Garmon | 229/120.17 |
| 4,219,147 | 8/1980 | Kohler | 229/120.17 |
| 4,318,470 | 3/1982 | Montealegre | 229/120.17 |
| 4,396,145 | 8/1983 | Ditton | 229/120.17 |
| 5,259,551 | 11/1993 | Davis | 229/162 |

*Primary Examiner*—Gary E. Elkins
*Attorney, Agent, or Firm*—Curtis, Morris & Safford, P.C.

[57] ABSTRACT

A box-shaped carton for holding a plurality of glassware articles or the like and for visibly displaying at least one of said articles. The carton includes a cutout opening in at least one of the vertical perimeter corners and extending into each side panel adjacent the perimeter corner so that an article disposed within said carton behind said cutout is visible from the exterior of said carton. The carton also has integral cell-dividers on the top and bottom, and can be folded into a sleeve when fully glued together. A blank for forming the carton is also provided.

16 Claims, 6 Drawing Sheets

47
43
44
40
41
214
35
31
37
33
34
213
30
45
113
103
123
5
93
5
25
21
23
20
24
212
27
211
15
10
17
14
13
11

70
60
100
110
80
120
90
50

CARTON FOR GLASS

FIELD OF THE INVENTION

The present invention relates generally to cartons for holding and displaying articles, especially glassware.

BACKGROUND OF THE INVENTION

Paperboard cartons or containers capable of holding a plurality of articles such as cans, bottles and the like are known. Such paperboard cartons are typically made from one or more blanks of paperboard, folded and glued together into a box.

Many of these paperboard containers have a built-in window in a side of the container so that the contents of the container may be viewed without opening the container. Although placing a window in a side of a container leaves all the corners of the box intact for vertical stiffness, it limits the viewing perspective of the articles contained within the box. With respect to some articles, it is also important to be able to view the article from a larger viewing angle and from other perspectives. For example, with glassware, it is often desirable to be able to view the glass contained within the box from above so that the lip of the glassware can be examined.

Cartons for packaging articles including dividers or separators for segregating the articles from each other have been proposed in the past. However, many of these prior art cartons require insertion of a separate divider, which means using a greater amount of paper board and increases the cost of the overall carton. In addition, many cartons possessing dividers require a separate operation to insert the dividers, which adds to the cost of the carton. Some efforts have been made to provide cartons with integral dividers. However, formation of the divider typically requires cumbersome folding steps after the box is expanded from a sleeve and glued together. Furthermore, the cartons cannot be conveniently collapsed into a sleeve after the carton is glued together (except for the top) for transportation to the user. Thus, the packer of the articles must have facilities and/or personnel available for gluing the box together and for folding the dividers on-site, at the time of packing, which increases cost and inconvenience.

OBJECTS OF THE INVENTION

An object of the present invention is to provide a carton for storing articles including glassware having a window for displaying the glassware such that multiple sides of the glassware are visible at the same time.

Another object of the invention is to provide a carton for storing glassware that uses integral dividers between the glassware to prevent breakage and reduce cost.

It is a further object of the invention to provide a carton which can be collapsed into a sleeve for transportation after it has been glued together.

Further objects of the invention will become clear as the description proceeds.

SUMMARY OF THE INVENTION

In accordance with a preferred embodiment of the present invention, a carton for holding a plurality of glassware articles or the like and for visibly displaying at least one of said articles is provided comprising a top, a bottom, and four side panels connected to each other along vertical fold lines to form rectilinear perimeter corners of said carton, each said side panel having an upper edge and a lower edge, at least one of said perimeter corners including a cutout opening therein, said cutout opening extending into each side panel adjacent said one of said perimeter corners so that an article disposed within said carton behind said cutout is visible from the exterior of said carton.

In accordance with another preferred embodiment of the present invention, a blank for producing a multicelled carton for holding a plurality of glassware articles or the like and for visibly displaying at least one of said articles is provided comprising: first, second, third and fourth side panel sections for forming a left side, a front side, a right side and a back side, arranged in a row and connected to each other along substantially parallel fold lines; first, second, third and fourth bottom panel sections connected by fold lines to respective ones of said first, second, third and fourth side panel sections; first, second, third and fourth top panel sections connected by fold lines to respective ones of said first, second, third and fourth side panel sections; means defining a first cutout between said first and second panel sections so that when said blank is folded into a completed carton, an article disposed within said carton behind said first cutout will be visible from the exterior of said carton through said first and second side panel sections.

DETAILED DESCRIPTION

Figure 4:
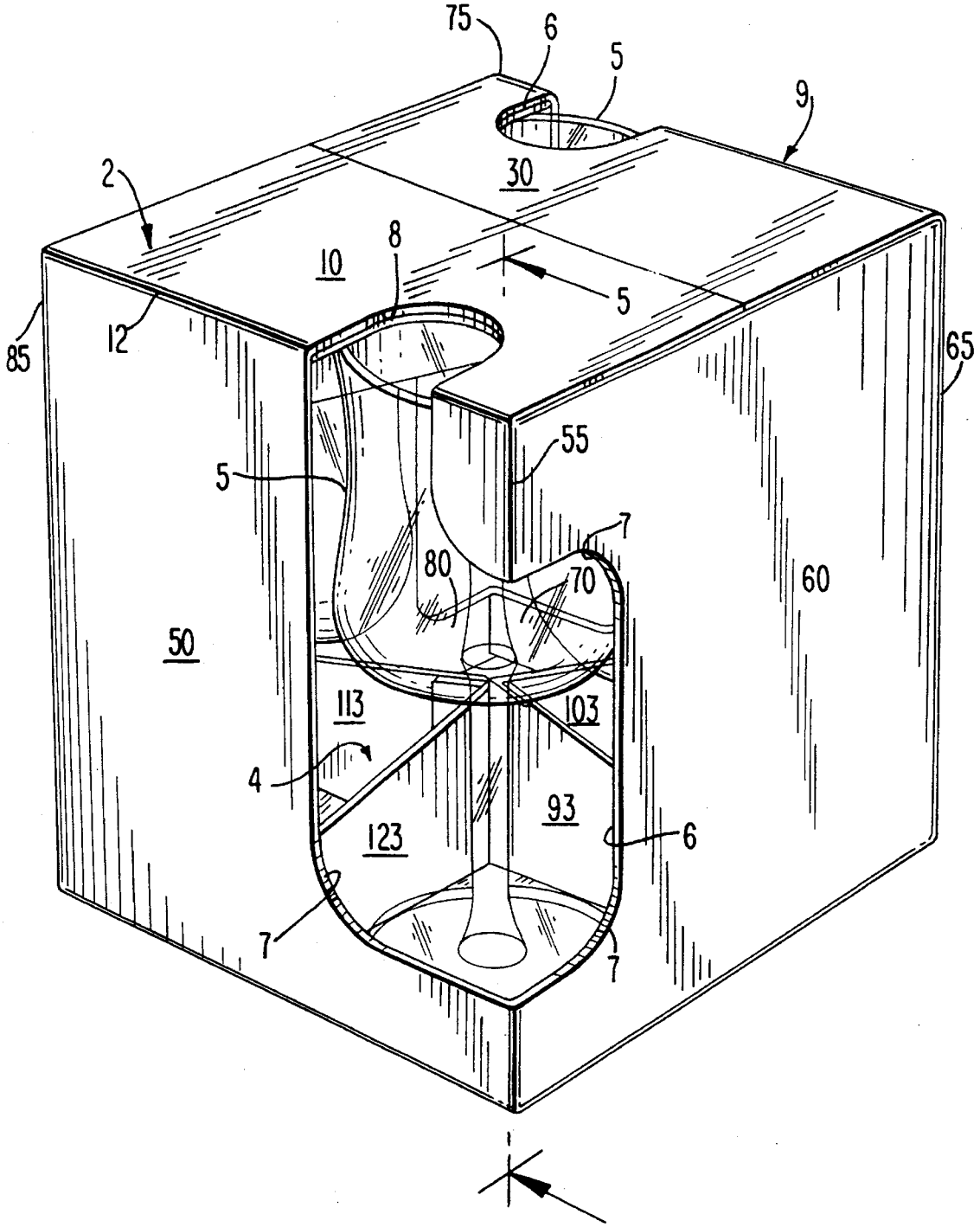
FIG. 4 is a perspective view of the carton, fully assembled with the top closed, the carton containing glassware articles.

Referring to the drawings in detail, and initially to FIG. 4 thereof, a fully assembled carton 1 in accordance with the invention is depicted. The carton 1 is box shaped with four side panels, 50 and 60 (visible in FIG. 4) and 70 and 80 (visible only partially from the inside as depicted in FIG. 4). Adjacent ones of side panels 50, 60, 70 and 80 are connected at rectilinear folded corners, corner 55 between side panels 50 and 60, corner 65 between side panels 60 and 70, corner 75 between side panels 70 and 80, and corner 85 between side panels 80 and 50.

The carton also includes a top 2 including external top flaps 10 and 30, a bottom 3 (part of the inside of which is visible in FIG. 4). The internal upstanding cell-divider 204 extends upwardly from the bottom 3 to create four "cells" in the carton to separate the articles 5. For purposes of illustrative example, the articles 5 are glassware, stem goblets, are depicted contained in each of the four cells formed by the upstanding cell-divider 204.

The carton includes a cutout opening 6 extending contiguously from side panel 50, through rectilinear corner 55, and into side panel 60. The cutout opening 6 preferably includes rounded corners 7. The portion of the cutout opening 6 in side panel 50 preferably extends contiguously upwardly through the rectilinear folded corner 12 formed between side panel 50 and top 2, and extending a substantial distance into top 2. Preferably, though not necessarily, the carton 1 also includes a similar cutout 6' in the diagonally opposite rectilinear corner 75, the top portion of which is visible in FIG. 4.

As can be seen in FIG. 4, owing to the fact that the cutout 6 extends contiguously between adjacent side panels, the glassware article 5 inside the carton is visible through a wide angle. The size of cutout opening 6 is also preferably large enough to permit articles to the left and right of the article immediately behind the cutout opening 6 to be at least partially viewed without opening the carton. This size is also preferably large enough to permit manual manipulation of the article. Thus, a prospective purchaser can handle and rotate the article behind the cutout 6 for inspection, without the need to open the carton.

The portion 8 of the cutout 6 extending into the top 2 permits the article 5 to be viewed at least partially from the top without opening the box. And because the article can preferably be manually rotated through cutout 6, the entire top of the article behind the cutout opening 6 can be inspected without opening the carton. Preferably, though not necessarily, cutout 6' also includes a portion 8', similar to portion 8, extending into the top 2.

The rectilinear corners of a carton normally give the carton weight supporting capability. Although the cutouts 6 and 6' extending through a portion of rectilinear corners 55 and 75 reduce the weight supporting capability, corners 65 and 85, which do not have cutouts, give the carton 1 sufficient weight-supporting capability.

Figure 1:
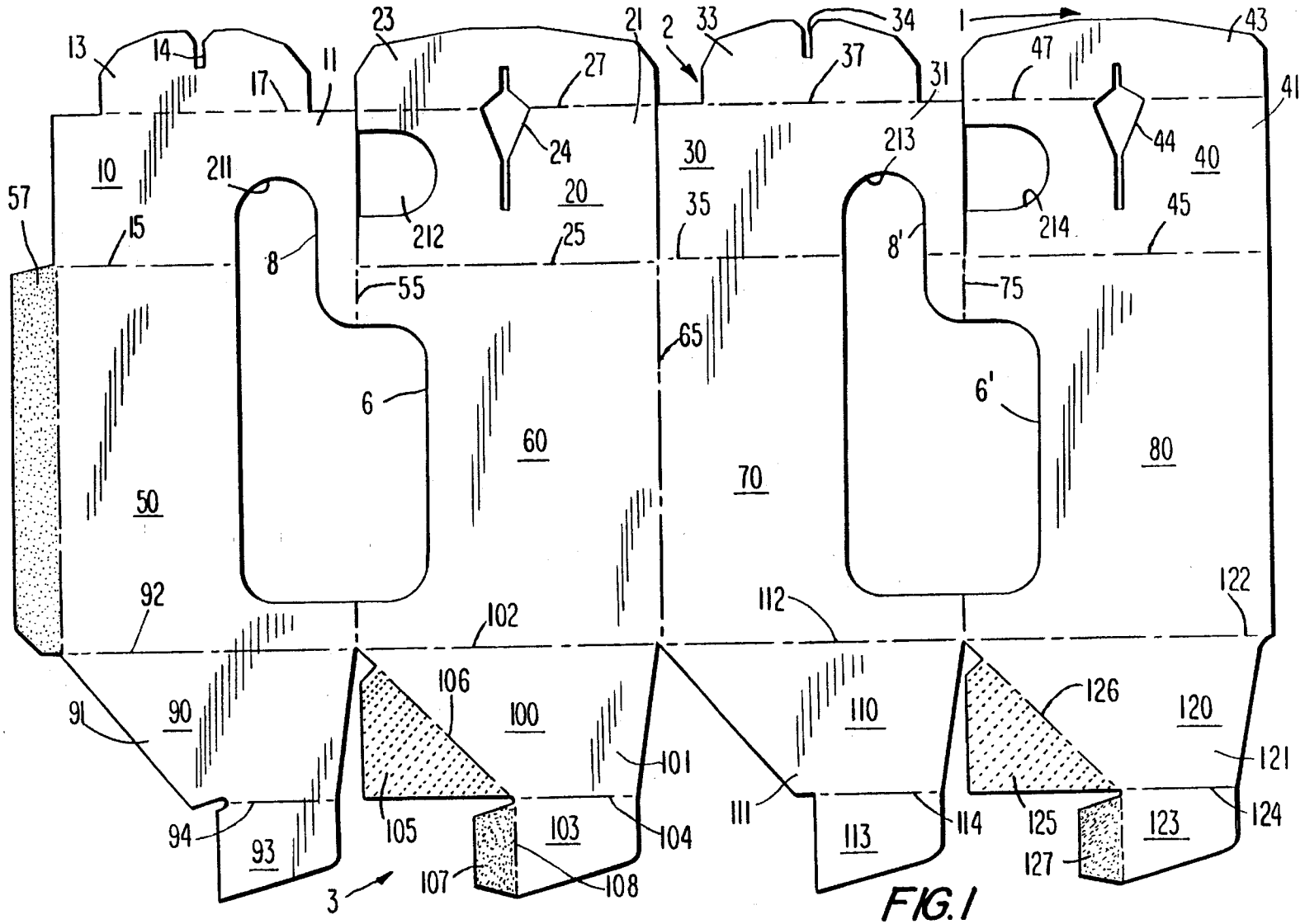
FIG. 1 is a plan view of a production blank used to form the carton of the invention.

With reference to FIGS. 1, 4, 5 and 8, the construction of the bottom 3, which preferably includes integral divider flaps 93, 103, 113 and 123, will now be described. Bottom 3 is comprised of bottom flaps 90, 100, 110 and 120. As shown in FIG. 1, which depicts the outer face of the production blank 9 for the carton 1 prior to folding or assembly, each of bottom flaps 90, 100, 110 and 120 respectively includes a generally trapezoidal flap portion 91, 101, 111 and 121 connected to the lower edge of its respective side panel section by fold lines 92, 102, 112 and 122, and a cell-divider flap portion 93, 103, 113 and 123 connected to the respective trapezoidal flap portion by respective fold lines 94, 104, 114 and 124. In addition, bottom flaps 100 and 120 respectively include generally triangular glue flaps 105 and 125 (the glue being placed on the back side, as indicated in the figure by the dotted lines) connected to trapezoidal flap portions along a diagonal fold lines 106 and 126 (the glue being placed on the back side, as indicated in the figure by the dotted lines), and glue tabs 107 and 127 (the glue being placed on the front side, as indicated in the figure by stippling), which are connected to the cell-divider flaps by vertical fold lines 108 and 128.

When the blank 9 is to be assembled into a carton, side panel sections 50 and 60 are folded inwardly along fold line 55 to form a vertical rectilinear corner. Simultaneously, bottom flap 90 is folded inwardly to form a horizontal rectilinear corner. Next, glue is applied to the inside face of triangular glue flap 105 of bottom flap 100. Then, bottom flap 100 is folded inwardly and flat against bottom flap 90, and glued to it, which holds the side panels 50 and 60 in the perpendicular relationship. Next, cell-divider flaps 94 and 104 are folded upwardly and inwardly into the interior of the carton being formed until they are substantially vertical. Then, glue is applied to the outside face of glue tab 107 and it is folded inwardly along fold line 108 and affixed to the outside face of the left edge of cell-divider flap 94, forming an upstanding "V" shaped cell-divider and retaining the bottom flaps in position. The same steps are then performed on bottom flaps 70 and 80. Then, the partially assembled carton is folded inwardly along fold line 65, bringing glue tab 57 adjacent to the edge of the inner face of panel section 50 (the glue being placed on the front face, as indicated in the figure by stippling). This also brings the apex of the respective upstanding "V" shaped cell-dividers into close proximity within the carton, forming the four-cell cell-divider 204 in the general shape of an "X". To complete the assembly of the carton, glue is attached to the outside face of glue tab 57, and glue tab 57 folded inwardly and affixed inside face of the left edge of side panel section 80.

Figure 2:
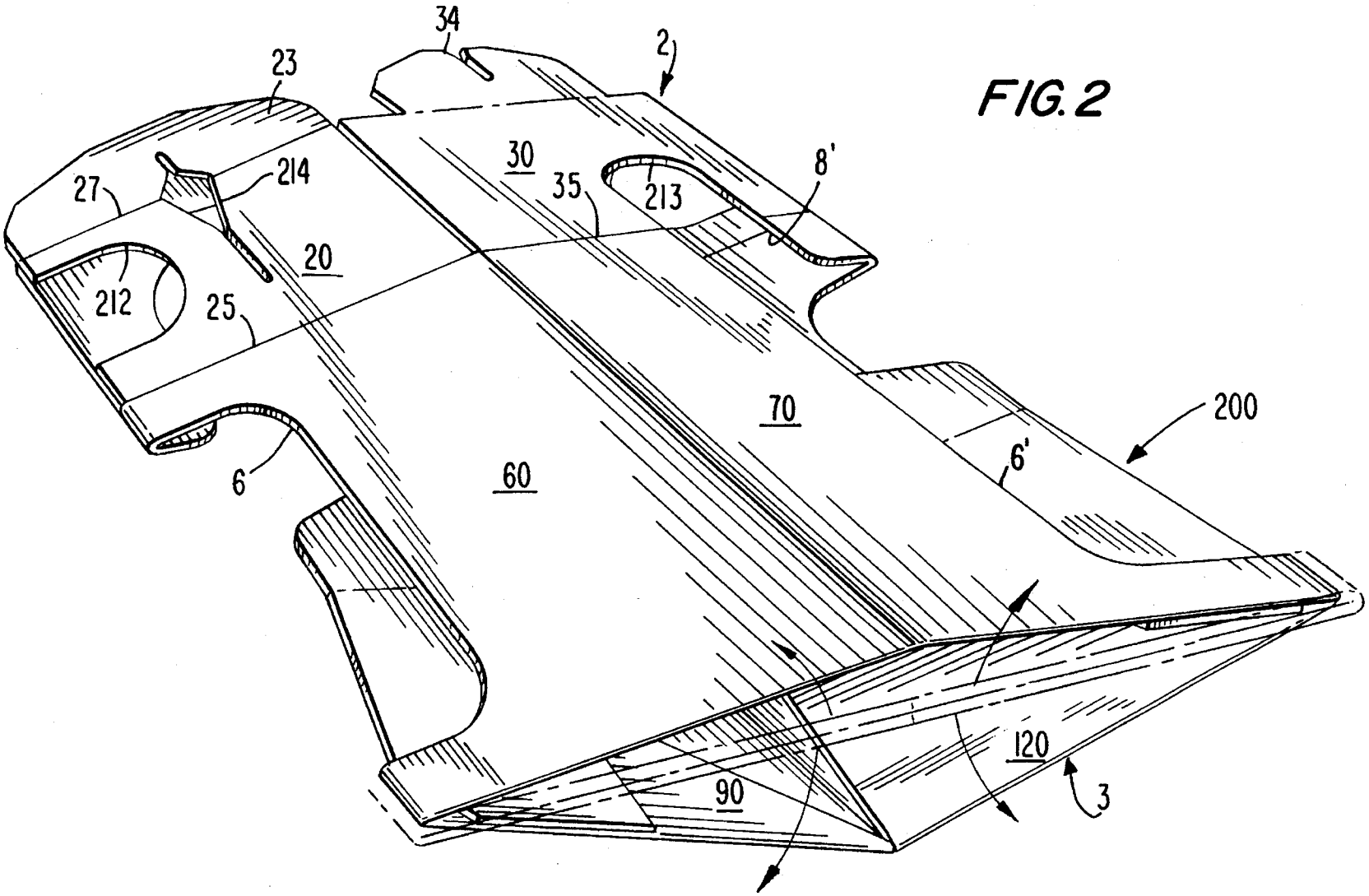
FIG. 2 is a perspective view from the bottom of the carton collapsed into a sleeve, as it is being expanded.

Owing to the novel construction of the "X" shaped (opposed "V" shaped) bottom cell-divider 204, the assembled carton can be readily collapsed into a flat sleeve 200 for storage and transportation without removal of the bottom cell divider, even after the carton is completely glued together. As depicted in FIG. 2, to collapse the carton into sleeve 200, pressure is applied to fold lines 65 and 85. This flattens the carton, simultaneously causing bottom flaps 90, 100, 110 and 120 to fold up and inwardly until substantially flat. Conversely, to expand the carton, pressure is applied to fold line 55 and 75. The panels then spread apart, as indicated by the arrows in FIG. 2. This process can be accomplished any number of times.

Figure 7:
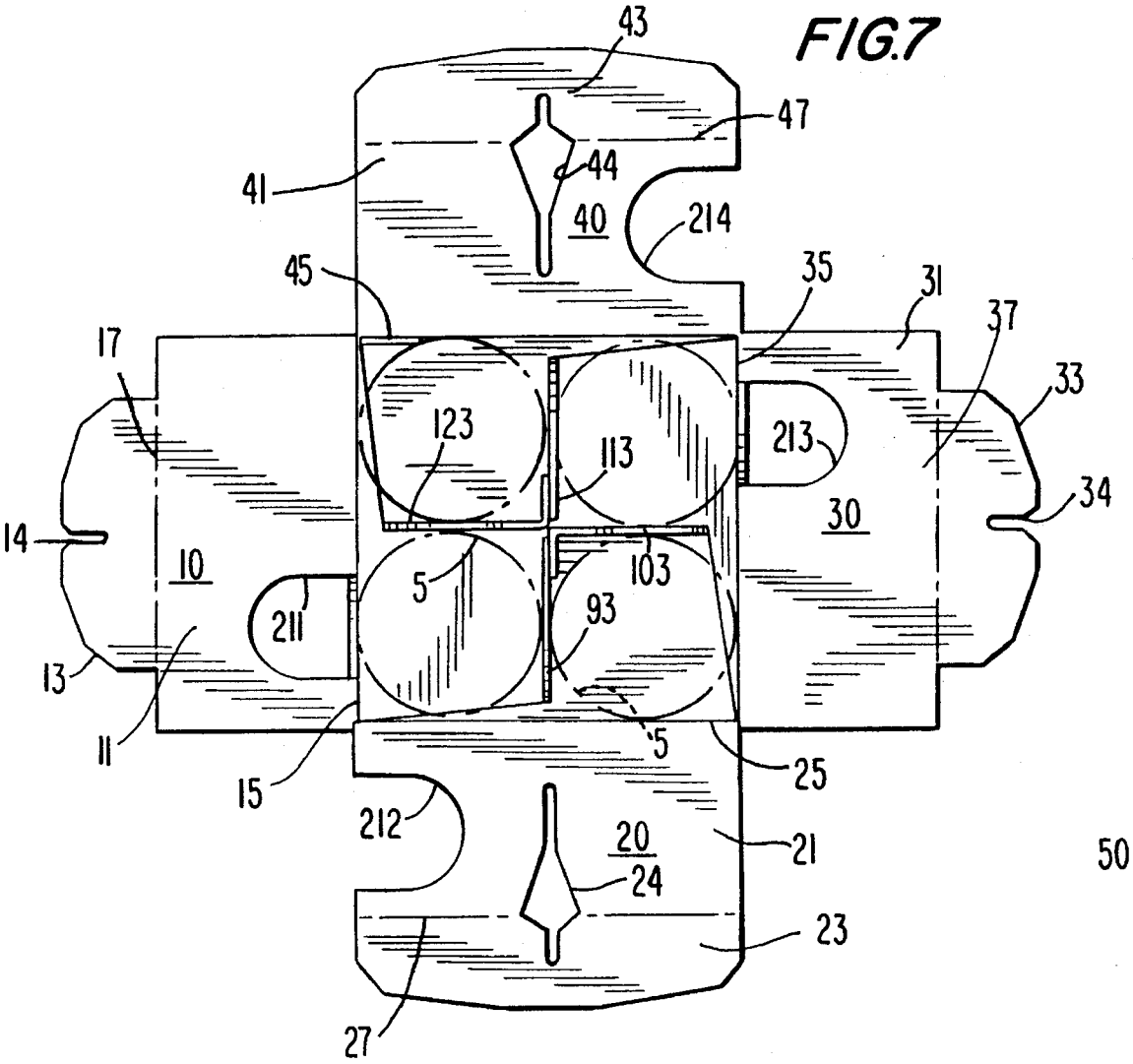
FIG. 7 is a plan view of the carton as assembled and containing glassware articles, but with the top fully open.
Figure 8:
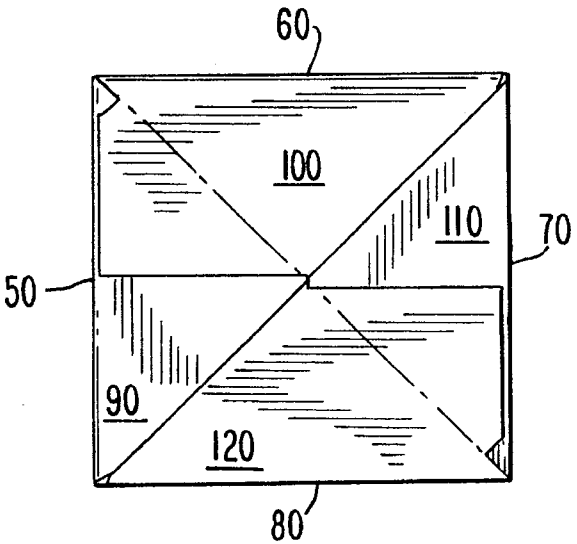
FIG. 8 is a bottom view of the carton, with the carton fully assembled and the bottom closed.

With reference now to FIGS. 7 and 8, the construction and operation of top 2 will be described. Top 2 is preferably comprised of top flaps 10, 20, 30 and 40. Each of top flaps 10, 20, 30 and 40 is respectively connected to sides 50, 60, 70 and 80 by respective fold lines 15, 25, 35 and 45. Each of top flaps 10, 20, 30 and 40 include respective generally rectangular portions 11, 21, 31 and 41. Rectangular portions 21 and 41 include respective generally semi-circular cutout portions 212 and 214 in one side, and rectangular portions 11 and 31 include respective semi-circular cutouts 211 and 213 extending from the fold lines 15 and 35. When top flaps 10, 20, 30 and 40 are closed, the semi-circular cutouts align, forming the cutout 6.

Top flaps 20 and 40 are inner top flaps and are opposed and similar to each other. Each includes a respective divider flap portion 23 and 43 connected to its respective top flap by a fold line 27 and 47 and a slot 44 (and 24) extending perpendicularly through the top flap, perpendicularly to fold lines 22 and 47. Preferably, slots 44 and 24 are widened in the middle, conveniently in a diamond shape, to facilitate receipt of the divider flaps 13 and 33 of top flaps 10 and 30 as described below.

Top flaps 10 and 30 are outer top flaps and are similar to each other. Each of these flaps includes a respective divider flap portion 13 and 33 connected to its respective top flap by a fold line 17 and 37. The extreme ends of divider flaps 13 and 33 each include slots 14 and 34.

Figure 3:
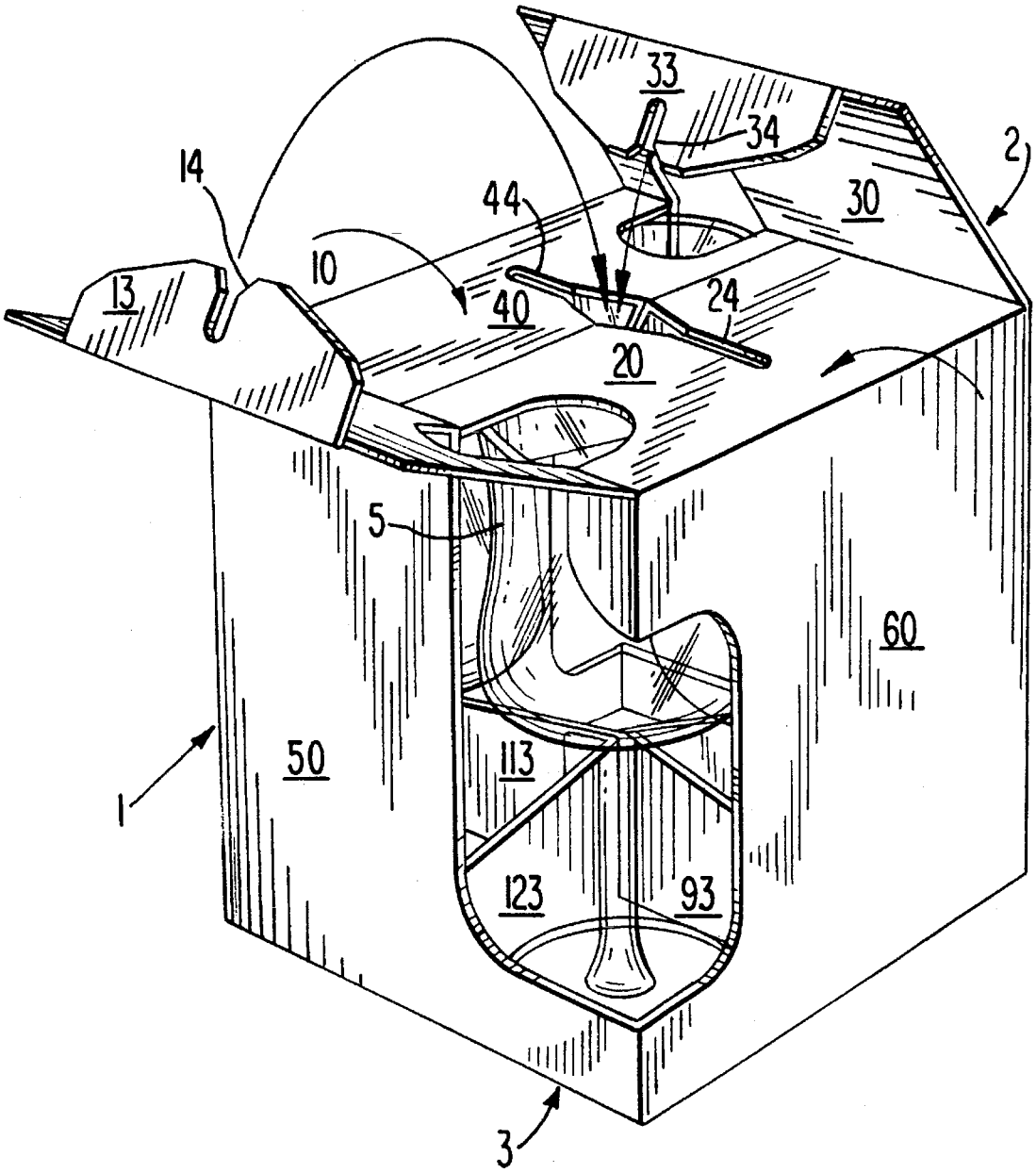
FIG. 3 is a perspective view of the carton, assembled except for the final closing of two top flaps and containing glassware articles.

As depicted in FIG. 3, to close the carton of the present invention, top flaps 20 and 40 are first folded inwardly, with divider flaps 23 and 43 pushed into the middle of the carton, between the articles. This places slots 14 and 34 together to form, in essence, one combined slot. Then, outer top flaps 10 and 30 are folded inwardly, with divider flaps 13 and 33 slid into the combined slot formed by slots 14 and 33.

Figure 6:
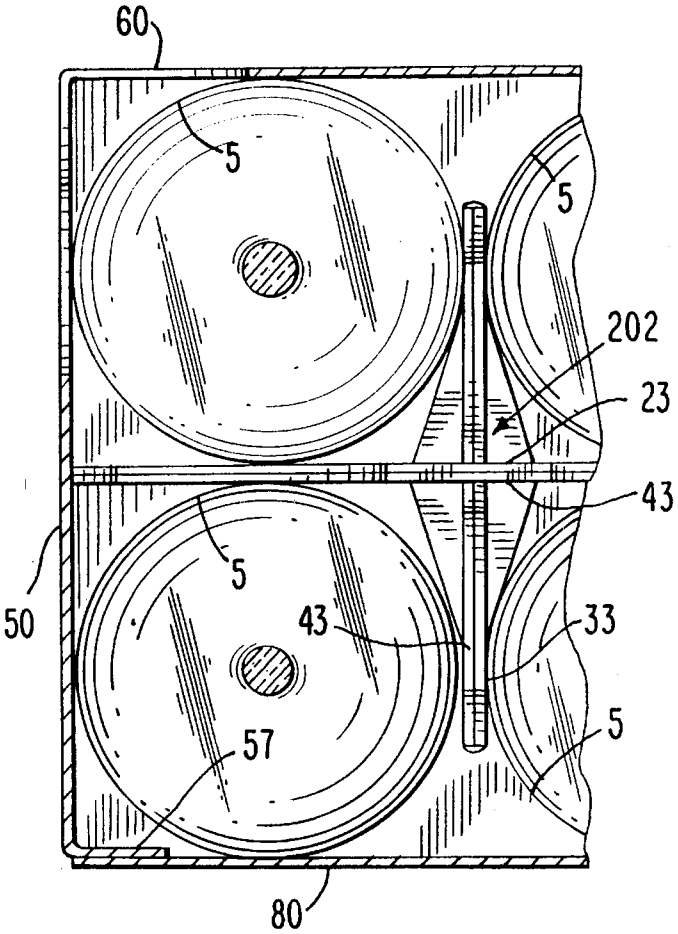
FIG. 6 is a sectional view of the carton of FIG. 5, taken along the line 6—6.
Figure 5:
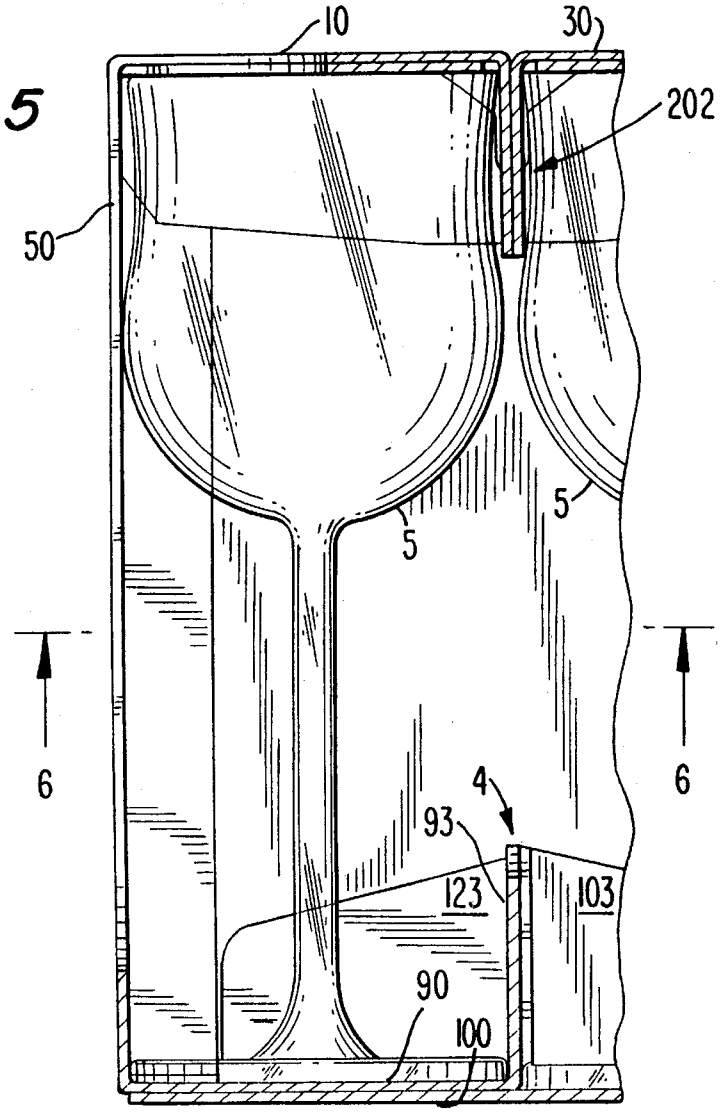
FIG. 5 is a sectional view of the carton of FIG. 4, taken along the line 5—5.

As can be seen in FIGS. 5 and 6, when top flaps 10, 20, 30 and 40 are fully closed, the divider flaps 13 and 33 criss-cross divider flaps 23 and 43, creating a downwardly extending four-cell cell-divider 202 which separates the top portion of the four articles. Furthermore, when the top flaps 10, 20, 30 and 40 are fully closed, slots 14 and 34 of divider flaps 23 and 43 will interlock with the divider flaps 13 and 33 and hold them together. This retains the top flaps firmly in place, without the need for glue. Thus, the top flaps can be conveniently opened and closed repeatedly, as desired. As can be seen in FIG. 5, the upper cell-divider 202 and the lower cell divider 204 are preferably spaced apart from each other by a substantial distance. Because there is clear space between the cell-dividers, viewing of more than one, and preferably all, articles is possible through either of the cutout openings 6, increasing the usefulness the carton in permitting prospective customers to view the contents without the need to open the carton.

Although the invention has been described in accordance with preferred embodiments, it will be seen by those skilled in the art that many modifications can be made within the sphere and scope of the present invention, and there is no intention to limit the scope of the present invention to solely these embodiments. Rather, the scope of the present invention is to be measured by the appended claims.

What is claimed is:

1. A carton for holding a plurality of glassware articles and for visibly displaying at least one of said glassware articles, said carton comprising a top, a bottom, and four side panels connected to each other along vertical fold lines to form rectilinear perimeter corners of said carton, each said side panel having an upper edge and a lower edge, at least one of said perimeter corners including a cutout opening therein and extending into each side panel adjacent said one of said perimeter corners so that an article disposed within said carton behind said cutout opening is visible from the exterior of said carton;

wherein said top includes:

a first pair of opposing top flaps, each of said top flaps being connected to a side panel along a first horizontal fold line at the upper edge of said side panel, each of said first pair of top flaps including a divider flap portion connected along a second horizontal fold line and a medial slot across and through said second horizontal fold line into said top flap and said divider flap portion, said divider flap portions each being downwardly foldable into the interior of said carton hear a midpoint of said carton and facing each other; and a second pair of opposing top flaps, each of said second pair of opposing top flaps being connected to a respective side panel along said first horizontal fold line at the upper edge of said respective side panel, each of said second pair of opposing top flaps including a divider flap portion connected along said second horizontal fold line, each of said divider flap portions including a notch at an end thereof and being downwardly foldable, through said medial slots of said first pair of opposing top flaps, into the interior of said carton near the midpoint of said carton and facing each other with said notch engaging said divider flap portions of said first pair of opposing top flaps and generally perpendicular to them to form a downwardly extending criss-crossed interior divider between said articles; and wherein said medial slots of said first pair of opposing top flaps are widened in a generally diamond-shape in the vicinity of said second horizontal fold line to facilitate receipt of said divider flap portions of said second pair of opposing top flaps.

2. The carton defined in claim 1, wherein said cutout opening is provided in each of two diagonally opposite perimeter corners.

3. The carton defined in claim 1, wherein a portion of said cutout opening extends contiguously from one of said side panels over said upper edge of said side panel with said cutout opening and into a portion of said top so that one of said plurality of glassware articles is also visible from the top of the carton.

4. The carton defined in claim 1, wherein said bottom includes a first pair of bottom flaps connected to respective ones of a first adjacent pair of side panels along a third horizontal fold line at the lower edges of said side panels, said bottom flaps of said first pair being overlappingly affixed together, and a second pair of bottom flaps connected to respective ones of a diagonally opposite second adjacent pair of said side panels, said bottom flaps of said second adjacent pair being overlappingly affixed together, each of said bottom flaps including a divider flap portion connected along a fourth horizontal fold line and being upwardly foldable into the interior of said carton to form upstanding interior dividers between said articles.

5. The carton defined in claim 4, wherein one of the divider flap portions of each of said first and second pair of bottom flaps includes a tab portion extending from a vertical fold line on its divider flap portion, said tab portion being affixed to a vertical edge of the divider flap portion of the other bottom flap of said adjacent bottom flap pair to form an upstanding "V" shaped interior divider, the apex of each upstanding "V" shaped interior divider being closely juxtaposed with the other upstanding "V" shaped interior divider together to form the general shape of an "X" when said carton is expanded.

6. The carton defined in claim 5, wherein said carton is collapsible into a flat sleeve configuration by folding said side panels of said first pair of adjacent side panels together along the vertical fold line between them, said side panels of said second pair of adjacent side panels along the vertical fold line between them while, simultaneously, said bottom panels fold up inwardly against their respective side panels and said divider flap portions Unfold along the vertical fold line between said tabs and their respective divider flap portions to lay against said side panels.

7. The carton defined in claim 1, wherein said bottom includes a first pair of bottom flaps connected to respective ones of a first pair of adjacent side panels along said third horizontal fold line at the lower edges of said side panels, said bottom flaps of said first pair being overlappingly affixed together, and a second pair of bottom flaps connected to respective ones of a diagonally opposite second pair of adjacent side panels, said bottom flaps of said second pair of adjacent side panels being overlappingly affixed together, each of said bottom flaps including a divider flap portion connected along said fourth horizontal fold line and being upwardly foldable into the interior of said carton to form upstanding interior dividers between said articles.

8. The carton defined in claim 7, wherein said upstanding interior dividers and said downwardly extending interior dividers are spaced a substantial distance apart from each other when extended into the interior of said carton so that said interior of said carton is visible from said exterior of said carton, between said upstanding interior dividers and said downwardly extending interior dividers.

9. A blank for producing a multicelled carton for holding a plurality of glassware articles and for visibly displaying at least one of said articles, comprising:

first, second, third and fourth side panel sections for forming a left side, a front side, a right side and a back side, arranged in a row and connected to each other along substantially parallel fold lines, first, second, third and fourth bottom panel sections connected by a first horizontal fold line to respective ones of said first, second, third and fourth side panel sections, first, second, third and fourth top panel sections connected by a second horizontal fold line to respective ones of said first, second, third and fourth side panel sections, means defining a first cutout extending contiguously between said first and second side panel sections so that when said blank is folded into a completed carton, an article disposed within said carton behind said first cutout will be visible from the exterior of said carton through said first and second side panel sections;

wherein said first and third top panel sections define a first pair of opposing top flaps, each of said first pair of opposing top flaps including a divider flap portion connected along a third horizontal fold line and a medial slot across and through said third horizontal fold line into said top flap and said divider flap portion, said divider flap portions each being foldable into the interior of said carton near a midpoint of said carton and facing each other when said carton is assembled and expanded;

said second and fourth top panels defining a second pair of opposing top flaps, each of said top flaps including a divider flap portion connected along said third horizontal fold line, each of said divider flap portions including a notch at an end thereof and being foldable into said carton when said carton is assembled and expanded, through said medial slots of said first pair of opposing top flaps, into the interior of said carton near the midpoint of said carton and facing each other with said notch engaging said divider flap portions of said first pair of opposing top flaps and generally perpendicular to them to form a downwardly extending criss-crossed interior divider between said articles; and wherein said medial slots of said first pair of opposing top flaps are widened in a generally diamond shape in the vicinity of said third horizontal fold line to facilitate receipt of said divider flap portions of said second pair of opposing top flaps.

10. The blank defined in claim 9, further comprising means defining a second cutout extending contiguously between said third and fourth panel sections so that when said blank is folded into a completed carton, an article disposed within said carton will also be visible from the exterior of said carton through said third and fourth side panel sections.

11. The blank defined in claim 10, wherein a portion of said means defining a first cutout extends contiguously from said first side panel section into a portion of said first top panel section so that when said blank is folded into a completed carton, an article disposed within said carton will also be visible from the exterior of said carton through said first top panel section.

12. The blank defined in claim 11, wherein said means defining a second cutout extends contiguously from said third side panel section into a portion of said third top panel section so that when said blank is folded into a completed carton, an article disposed within said carton will also be visible from the exterior of said carton through said third top panel section.

13. The blank defined in claim 9, wherein said first, second, third and fourth bottom panel sections have a generally trapezoidal shape portion and an upstanding cell-dividing flap portion connected to their respective bottom panel section by a fold line, said second and fourth bottom panel sections further having a triangular glue flap portion connected to said trapezoidal shape portion along a diagonal fold line and a glue flap portion connected to said upstanding cell-dividing flap portion along a vertical fold line so that when said carton is assembled, said cell-divider flap portions of said first and second bottom panel sections, and said second and third bottom panel sections, form respective upstanding "V" shaped interior dividers, the apex of each of said upstanding "V" shaped interior dividers being closely juxtaposed together to form the general shape of an "X" when said carton is assembled and expanded.

14. A carton for holding a plurality of glassware articles and for visibly displaying at least one of said glassware articles, said carton comprising a top, a bottom, and four side panels connected to each other along vertical fold lines to form rectilinear perimeter corners of said carton, each said side panel having an upper edge and a lower edge, at least one of said perimeter corners including a cutout opening therein and extending into each side panel adjacent said one of said perimeter corners so that an article disposed within said cutout opening is visible from the exterior of said carton with a portion of said cutout opening extending contiguously from an upper edge of at least one of said side panels containing said cutout opening and into a portion of said top so that one of said plurality of glassware articles is also visible from the top of the carton, and corner retaining means formed at an intersecting corner of said top and said upper edges of said adjacent side panels adjacent to said cutout opening for retaining the glassware article visible through said cutout opening.

15. The carton defined in claim 14, wherein said cutout opening is provided in each of two diagonally opposite perimeter corners.

16. A blank for producing a multicelled carton for holding a plurality of glassware articles and for visibly displaying at least one of said articles, comprising:

first, second, third and fourth side panel sections for forming a left side, a front side, a right side, and a back side, arranged in a row and connected to each other along substantially parallel fold lines, first, second and fourth bottom panel sections connected by a first horizontal fold line to respective one of said first, second, third and fourth side panel sections, first, second, third and fourth top panel sections connected by a second horizontal fold line to respective ones of said first, second, third and fourth side panel sections, means defining a first cutout extending contiguously between said first and second side panel sections so that when said blank is folded into a completed carton, an article disposed within said carton behind said first cutout will be visible from the exterior of said carton through said first and second side panel sections wherein a portion of said means defining a first cutout extends contiguously from said first side panel section into a portion of said first top panel section to that when said blank is folded into a completed carton, an article disposed within said carton is visible from the exterior of said carton through said first top panel section, and cover retaining means is formed at an intersecting corner of said first top panel section and said first and second side panel sections adjacent to said means defining a first cutout so that when said blank is folded into a completed carton, the article visible through said top panel section and said first and second side panel sections will be retained therein.

* * * * *